United States Patent [19]

Yamaguchi

[11] Patent Number: 4,711,170

[45] Date of Patent: Dec. 8, 1987

[54] PRINTING WIRE DRIVING DEVICE IN WIRE DOT PRINTER

[75] Inventor: Morio Yamaguchi, Tokyo, Japan

[73] Assignee: Max Co., Ltd., Tokyo, Japan

[21] Appl. No.: 813,934

[22] Filed: Dec. 27, 1985

[30] Foreign Application Priority Data

Dec. 27, 1984 [JP] Japan ..... 59-200760[U]
Nov. 29, 1985 [JP] Japan ..... 60-182910[U]

[51] Int. Cl.[4] ..... B41J 3/12

[52] U.S. Cl. ..... 101/93.05; 101/93.31; 400/124; 400/157.1

[58] Field of Search ..... 101/93.04, 93.05, 93.30, 101/93.31, 93.29, 93.32, 93.33, 93.34, 93.48; 400/124, 157.1, 157.2

[56] References Cited

U.S. PATENT DOCUMENTS

| | | | |
|---|---|---|---|
| 3,561,355 | 2/1971 | Rapparlie et al. | 400/124 |
| 3,977,509 | 8/1976 | Leershijder | 101/93.33 |
| 4,397,573 | 8/1983 | Thiel | 400/124 |
| 4,472,072 | 9/1984 | Haracla et al. | 400/157.2 |

*Primary Examiner*—Edgar S. Burr
*Assistant Examiner*—David A. Wiecking
*Attorney, Agent, or Firm*—Cushman, Darby & Cushman

[57] ABSTRACT

The present invention relates to a printing wire driving device in a wire dot printer which can perform accurate control with small power and has a large printing wire driving power. In the present invention, a driving member is driven by an eccentric cam. The printing wire can be positively driven with high accuracy by this driving member when a maintaining electromagnet or piezo-actuator holds the wire and driving member in alignment. Otherwise, a biasing member pushes the wire or driving member out of alignment.

17 Claims, 15 Drawing Figures

PRINTING WIRE DRIVING DEVICE IN WIRE DOT PRINTER

BACKGROUND OF THE INVENTION

1. Field of the Industrial Application

The present invention relates to printing wire driving devices in wire dot printers, and more particularly to a printing wire driving device in a wire dot printer which can perform accurate control with small power and has a large printing wire driving power.

2. Description of the Prior Art

With dot printers are used to print characters, symbols, etc. in dot form by striking printing wires. In this connection, a variety of printing wire driving devices have been proposed in the art.

One example of the conventional driving devices is shown in FIG. 1. In the driving device, its driving lever 100 is pivotally supported at one end, and the other end is coupled to a printing wire 101. The other end is further coupled to a spring 102 to return the lever 100. As the electromagnet 103 provided on the side of the printing wire 101 attract the driving lever 100, the printing wire 101 is caused to strike the platen 105 in the direction of the arrow, as a result of which a character is printed on the printing sheet p disposed between the platen and the printing ribbon 104.

FIG. 2 shows a second example of the conventional driving device. In the driving device, its driving lever 110 is pivotally supported at one end, and the other end is coupled to a printing wire 101. A spring 111 is connected to the driving lever 110 near the other end in order to urge the driving lever towards the platen 105, or in the printing wire driving direction. A permanent magnet 112 to attract the driving lever 110 is provided on the side of the driving lever 110 which is opposite to the side where the printing wire 101 is provided. A coil 113 is wound on the permanent magnet 112. The force of attraction of the permanent is cancelled out by energizing the coil 113, as a result of which the driving lever 110 is driven by the spring and the printing wire 101 is moved in the direction of the arrow in FIG. 2 to print a character on the printing sheet P.

In the driving device of FIG. 1, the printing wire 101 is driven by the electromagnet 103. In the driving device of FIG. 2, the printing wire is driven by the spring 111. Therefore, in these driving devices, the printing wire driving force is limited; that is, it is impossible to obtain a sufficiently large driving force. The large driving force may be obtained by using a large electromagnet 103 in the driving device of FIG. 1. In the case of the driving device of FIG. 2, the large driving force may be obtained by using a stronger driving spring 111 and a large permanent magnet 112. However, these methods are disadvantageous in that a mechanism for driving a plurality of printing wires becomes bulky.

As was described above, each of the above-described driving devices cannot provide a sufficiently large driving force, and therefore cannot perform an emboss printing operation. A wire dot printer having the driving device cannot be used, for instance, as a check writer. In addition, since the driving force is insufficient, characters cannot be printed on a plurality of printing sheets simultaneously.

In order to overcome these difficulties, a printing wire driving device which uses a rotary cam to obtain a large driving force has been proposed.

The conventional driving device is as shown in FIG. 3. A returning spring 121 is connected to one end of a driving lever 120 in order to urge the latter 120 in the axial direction. A printing wire 101 is connected to the other end of the driving lever in such a manner that the wire 101 is extended in the axial direction. A control electromagnet 122 is arranged near the driving lever 120 with a gap therebetween. When the control electromagnet 122 is energized according to a printing instruction, the driving lever 120 is attracted by the electromagnet 122, i.e., it is moved downwardly in the figure. As a result, a protruded piece 123 which is connected to the printing wire 101 is struck by a rotating cam 124, so that the printing wire 101 is jerked to the platen 105, in the direction of the arrow in the figure, to print the character on the printing sheet P.

In the driving device of FIG. 3, the printing wire 101 can be sufficiently driven by the driving force of the rotating cam 124. However, since the driving control is performed by causing the control electromagnet 122 to directly attract the driving lever 120, the electromagnet 122 should have a large force of attraction. As was described above, a large force is required for performing the driving control. Accordingly, it is rather difficult to positively perform the driving control according to the printing instruction, and it is unavoidable to employ a relatively bulky electromagnet as the control electromagnet 122.

Furthermore, since the gap is provided between the driving lever 120 and the control electromagnet 122, a time lag occurs in the driving control.

SUMMARY OF THE INVENTION

As is apparent from the above description, a conventional printing wire driving device for wire dot printers suffers from a difficulty that it is impossible to sufficiently increase the printing wire driving force.

Even if a large printing wire driving force is obtained, these are still problems to be solved that the driving control cannot be positively carried out, and a time lag occurs with the driving control.

An object of the present invention is to eliminate the above-described drawbacks accompanying a conventional printing wire driving device for wire dot printers. More specifically, an object of the present invention is to provide a printing wire driving device for wire dot printers in which the printing wire driving force is large, and the driving control can be achieved positively by a small power without a time lag.

The foregoing problems have been solved by the provision of the printing wire driving device for a wire dot printer which, according to the present invention, comprises: a printing wire one end of which is hammered for printing, a wire driving member arranged in such a manner as to confront with the one end of the printing wire and to be able to hammer the printing wire; an eccentric cam adapted to drive the wire driving member in the printing wire hammering direction; a first elastic member for returning the printing wire to the original position which has been hammered by the wire driving member; a second elastic member which urges at least one of the wire driving member and printing wire so that the one end of the printing wire and the wire driving member are set aside from each other; guide means for making the wire driving member and the one end of the printing wire flush with each other against the second elastic member; and holding means for operatively maintaining the wire driving member and the one end of the printing wire flush with each other according to a printing instruction.

In the printing wire driving device of the present invention, the printing wire is driven by the rotating cam, and therefore the printing wire driving force is relatively large.

Furthermore, the power required for the printing control is small. Therefore, the power consumption of the holding means is small, the holding means such as a control electromagnet can be a small one, and the printing control can be positively achieved.

As the electromagnet is abutted against the wire driving member, the control can be accomplished with no time lag.

BRIEF DESCRIPTION OF THE DRAWINGS

FIG. 8 shows the standby state of the driving device, and FIG. 10 shows the striking stage of the driving device.

FIGS. 12, 13 and 14 show, the standby state, the disengagement state, and the striking state of the driving device shown in FIG. 11.

DETAILED DESCRIPTION OF THE PREFERRED EMBODIMENTS

First and second preferred embodiments of the invention will be described with references to the accompanying drawings.

The first embodiment of the invention will be described with reference to FIGS. 4 through 10.

Figure 1:
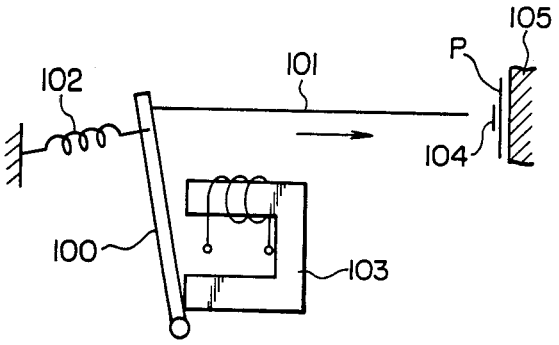
FIGS. 1, 2 and 3 are explanatory diagrams showing examples of a conventional printing wire driving device.
Figure 2:
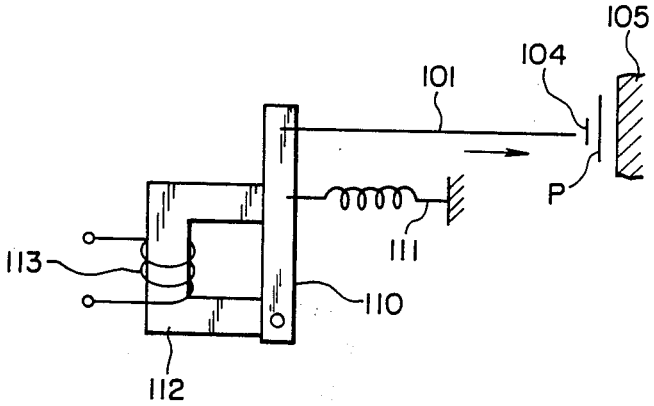
Figure 3:
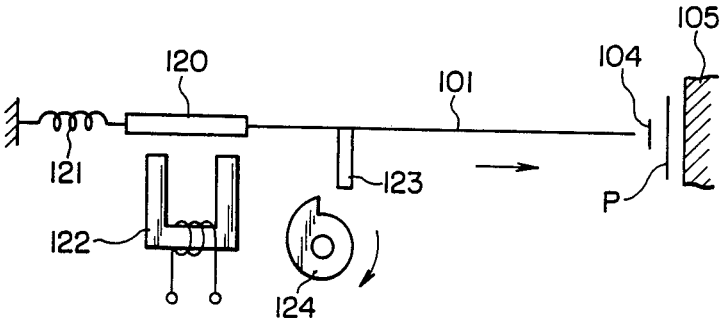
Figure 4:
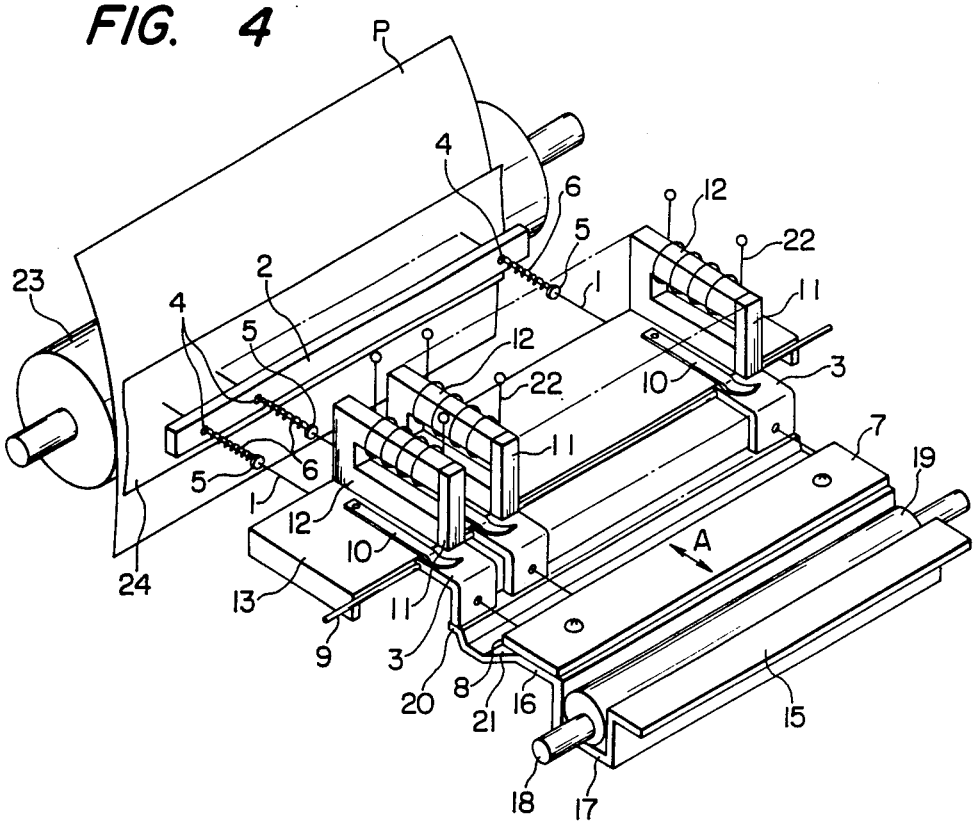
FIG. 4 is a perspective view of a printing wire driving device for wire dot printers which is a first embodiment of the present invention.

FIG. 4 is a perspective view of a printing wire driving device in wire dot printers which is the first embodiment.

As shown in FIG. 4, printing wires 1 the rear ends of which are struck for printing characters are mounted in such a manner that the front end portions thereof are passed through a wire holding board 2, and the rear end portions thereof are passed through wire holding members 3.

The wire holding board 2 has a plurality of wire inserting through-holes 4 arranged in the longitudinal direction, so that the printing wires 1 are inserted into the through-holes 4, respectively.

Each of the printing wires 1 has a spring locking part 5. A first elastic member, namely, a returning spring 6 is mounted on the printing wire 1 in such a manner that it is located between the spring locking part 5 and the wire holding board 2. Therefore, the printing wire 1 struck is returned to the original position by the elastic force of the returning spring 6.

The wire holding members 3 are provided respectively for the printing wires, and are used to allow the rear end portions of the printing wires 1 to disengage from the hammering part 8 of a driving board 7 (described later). Each wire holding members 3 is substantially L-shaped and is made up of two side pieces **3*a* and 3*b*. The wire holding members 3 are swingably mounted, at the side piece 3*a*, on a stationary shaft 9 which is perpendicular to the printing wires 1. The printing wires 1 are slidably inserted into the other side pieced 3*b*. Therefore, as each wire holding member 3 swings about the stationary shaft 9, the rear end of the respective printing wire 1 is disengaged from the driving board 7**.

One end of a second elastic member, namely, a leaf spring 10 the other end of which is fixed is abutted against one side of the side piece **3*a* of the respective wire holding member 3 so that the latter 3 is urged to cause the end of the printing wire to disengage from the driving board 7**.

Armatures 11 are placed vertical on the side pieces **3*a* of the wire holding members 3, respectively. Control electromagnets 12, which are substantially U-shaped, confront with the armatures 11, respectively. The control electromagnets 12** attracts the armatures in response to printing instructions, respectively.

Each control electromagnet 12 operators to attract the respective armature 11 thereby to position the printing wire in place against the elastic force of the leaf spring 10.

The control electromagnets 12 together with armature 11 provided for the wire holding members 3 are arranged on the device body.

Bearers 13, which are struck by the driving board 7, are mounted on the rear ends of the printing wires 1. The driving board 7 adapted to strike the plurality of printing wires 1 simultaneously is arranged in such a manner as to confront with the bearers 14 of the printing wires 1.

One side of the driving board 7 is a striking part 8 adapted to strike the bearers 14 of the printing wires 1. The driving board 7 is mounted on a driving-board mounting part 16 which is integral with a guide member 15 and is provided on the side of the printing wires, in such a manner that the driving board 7 confronts the bearers 14 of the printing wires 1.

The guide member 15 has an engaging part 17 which is engaged with an eccentric cam 19 which is mounted on a rotary shaft 18 connected to a driving motor (not shown). As the eccentric can 19 rotated, the guide member 15 is reciprocated in the directions of the arrow A in FIG. 4, and accordingly the driving board secured to the guide member 15 is moved to strike the printing wires 1.

The guide member 15 has a supporting part 20 on the side of the printing wires 1. The supporting part 20 has one end which is abutted against the side pieces **3*b* of the wire holding members 3. The supporting part 20 supports the bearers 14 of the printing wires 1 supported by the wire holding members 3 in such a manner that the bearers 14 confront with the striking part 8 of the driving part 7. The supporting part 20 is so shaped that it falls from the end of the driving board mounting part 16 through a relief part 21 provided for the ends of the sides 3*a* of the wire holding members 3**.

Figure 6:
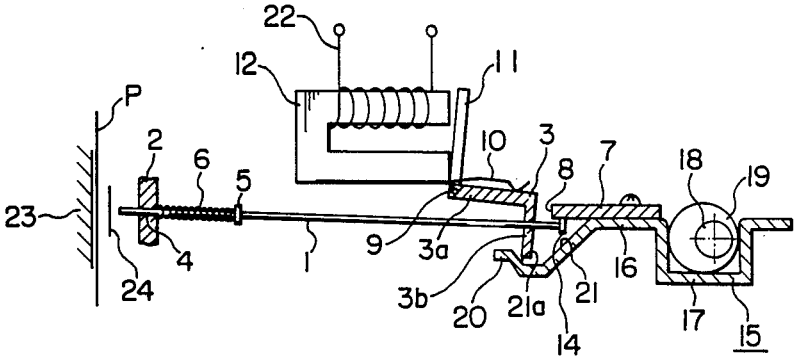
Figure 7:
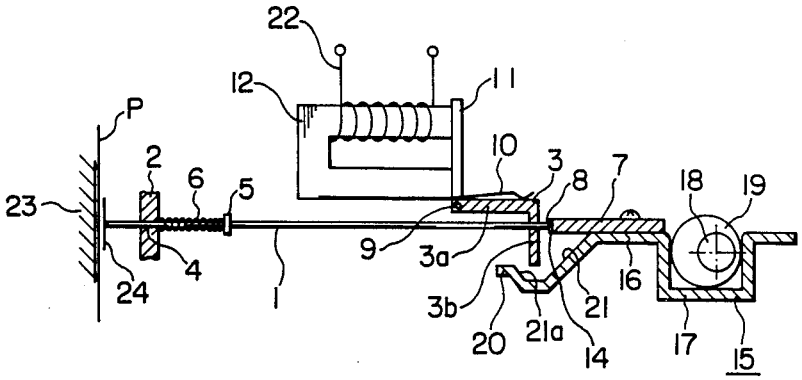

The operation of the printing wire driving device thus constructed will be described with reference to FIGS. 5 through 7.

Figure 5:
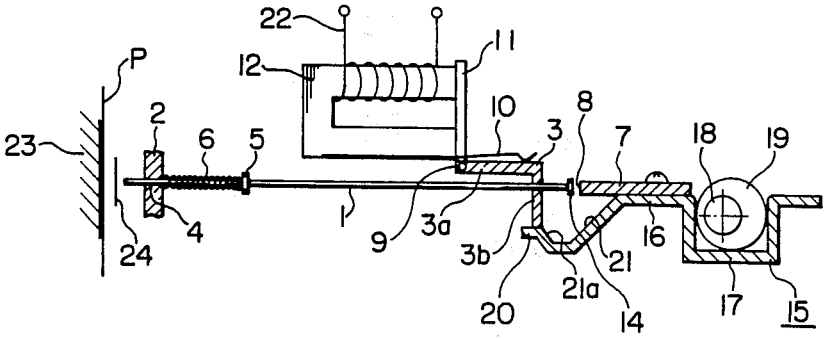
FIGS. 5, 6 and 7 are side views depicting the operation of the driving device shown in FIG. 4.

FIG. 5 shows the standby state of the device in which the guide member 15 is not driven by the eccentric cam 19. In the standby state, the side pieces 3b of the wire holding members 3 are on the supporting part 20 of the guide member 15 so that the armatures 11 for the wire holding members 3 are abutted against the control electromagnets 12, respectively.

Subsequently the eccentric cam 19 is rotated to move the guide member 15 in the printing wire striking direction. Accordingly, the driving board 7 mounted on the guide member 15 is moved in the same direction at the same time. However, in the case when no printing instruction is provided and the armatures 11 held vertical on the wire holding members 3 are not attracted by the control electromagnets 12, the guide member 15 is driven as shown in FIG. 6. When the guide member 15 held as shown in FIG. 5 is driven as shown in FIG. 6, the wire holding members 3 are turned about the stationary shaft 9 by the elastic forces of the leaf springs 10 because the armatures 11 of the wire holding members 3 are not attracted by the control electromagnets 12. As a result, the ends of the side pieces 3b of the wire holding members 3 are slid down the sloped surface 21a of the relief part 21 from the supporting part 20 of the guide member while the rear end portions of the printing wires 1 supported by the wire holding members 3 are swung downwardly as shown in FIG. 6. Therefore, the bearers 14 at the rear ends of the printing wires 1 are caused to leave the positions where they confront with the striking part 8 of the driving board 7 which is adapted to strike the bearers 14. Accordingly, in this case, the printing wires 1 are not driven, and no printing operation is carried out.

The eccentric cam 19 is further turned to return the guide member 15 to the above-described standby position. As the guide member 15 is moved in this manner, the ends of the side pieces 3b of the wire holding members are displaced from the relief part 21 of the guide member 15 to the supporting part 20, so that the armatures 11 are abutted against the control electromagnets 12, respectively, while the bearers 14 at the ends of the printing wires 1 are confronted with the driving board 7 of the guide member 15; that is, the bearers are set at the standby positions as shown in FIG. 5.

When the coil 22 of the control electromagnet 12 is energized according to the printing instruction, the armature 11 attached to the wire holding member 3 is attracted by the control electromagnet 12. Therefore, when the guide member held in the standby state as shown in FIG. 5 is moved in the printing wire striking direction by the rotation of the eccentric cam 19 as shown in FIG. 7, although the end of the side piece 3b of the wire holding member 3 is moved from the supporting part 20 of the guide member 15 the wire holding member 3 is held, as it is, by the control electromagnet 12 against the elastic force of the leaf spring 10. Accordingly, the bearer 14 of the printing wire 1 is maintained confronted with the striking part 8 of the driving board 7 mounted on the guide board 15 so as to be struck by the striking part 8. As the printing wire 1 is struck in this manner, the front end of the printing wire 1 strikes the printing sheet P disposed between the platen 23 and the printing ribbon 24 to print the character on the printing sheet P.

As the eccentric cam 19 is further rotated, the guide member 15 and accordingly the printing wire 1 are returned to the original positions similarly as in the above-described case where no printing operation is carried out.

As is apparent from the above description, when the printing wire driving device is in the standby state the armatures 11 of the wire holding members 3 are abutted against the control electromagnets 12, respectively, and therefore the armatures 11 of the wire holding members 3 can be held according to the printing instruction without a time lag. Accordingly, the printing wires 1 can be driven with high accuracy.

As the printing wires 1 are driven by the rotating eccentric cam 19, the driving force of the driving device is relatively large. Therefore, with the driving device, the embossing type printing operation or the copying type printing operation can be carried out. Accordingly, the printer equipped with the driving device can be used as a check writer for instance. Desired characters or symbols, which are not limited to those of fixed types, can be emboss-printed in dot form.

In the above-described driving device, in driving the printing wire the armatures 11 of the wire holding member 3 is attracted by the electromagnet 12. This printing control can be achieved by the small power which is merely against the elastic force of the leaf spring 10.

Accordingly, the printing control can be positively carried out, the power consumption for the control is small, and the electromagnet 12 can be miniaturized. The driving device is simple in construction, which contributes to a reduction of the manufacturing cost of the wire dot printer.

In the above described embodiment, the electromagnets are employed to control the wire holding members 3. Since the wire holding members 3 can be controlled with considerably small power, instead of the electromagnets, transducers, namely, piezo-actuator can be used.

A printing wire driving device employing the piezo-actuator will be described with reference to FIGS. 8 through 10.

The piezo-actuator is made up of piezo-electric ceramics. Voltage is applied to a piezo-electric bimorph vibrator which is fixed at one end, so that a displacement proportional to the voltage thus applied is obtained at the other end.

Figure 8:
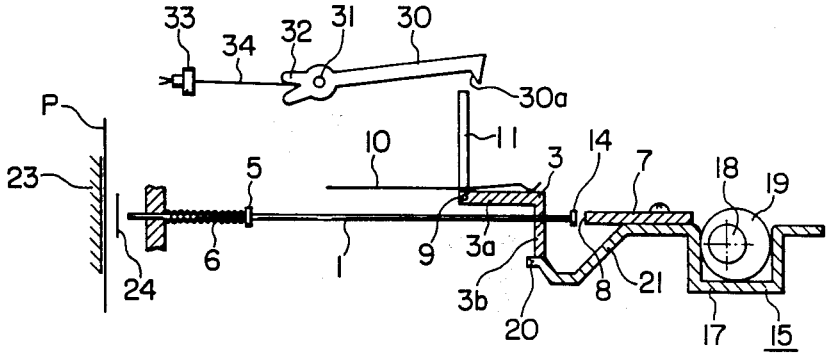
FIGS. 8, 9 and 10 are side views depicting the operation of the driving device of FIG. 4 which is so modified that a piezo-actuator is employed as its holding means. More specifically.
Figure 9:
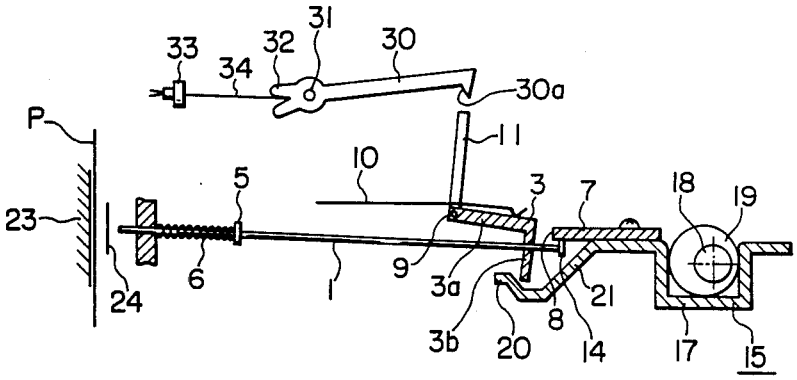
Figure 10:
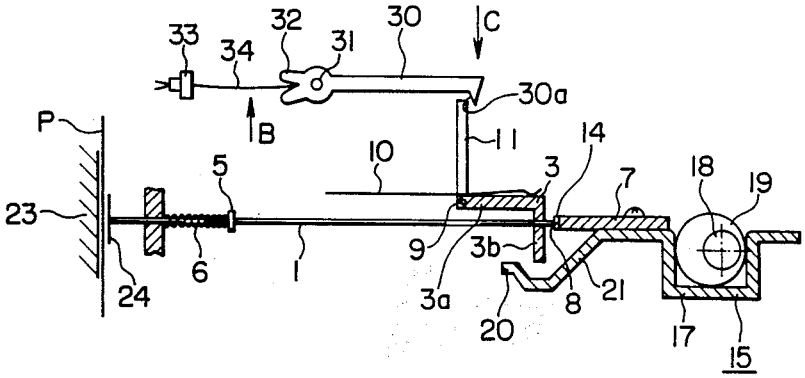

As shown in FIGS. 8 through 10, the armature 11 of each wire holding member 3 is provided with a hook lever 30 the end portion of which is bent so that it is engaged with the end portion of the armature 11.

The base end portions of the hook levers 30 are rotatably mounted on a stationary shaft 31x. A substantially V-shaped cut 32 is engaged with one end of a piezo-actuator 34 the other end of which is secured to a stationary member 33.

When no printing instruction is issued and the piezo-actuator 34 is not energized, the end portion of the hook lever 30, namely, a hook 30a is maintained disengaged from the armature 11 of the wire holding member 3 as shown in FIG. 8. In this case, as was described before, as the guide member 15 is moved, the side piece 3b of the wire holding member 3 is guided from the supporting part 20 to the relief part 21 by the elastic force of the leaf spring 10, so that the rear end portion of the printing wire 1 is moved away from the striking part 8 of the driving board 7. Accordingly, the printing wire 1 is not driven.

When the piezo-actuator 34 is energized according to the printing instruction, the one end of the actuator 34 is displaced in the direction of the arrow B in FIG. 10, as a result of which the hook lever 30 is turned about the stationary shaft 31 in the direction of the arrow C in FIG. 10 while the hook 30*a* engaged with the end of the armature 11 of the wire holding member 3. Therefore, when, under this condition, the guide member 15 is driven, the printing wire 1 held by the wire holding member 3 is so positioned as to confront with the driving board. Accordingly, the driving board 7 strikes the printing wire 1 to print the character.

A second embodiment of the invention will be described with reference to FIGS. 11 through 16.

In the first embodiment described above, the printing wire is driven in order that the printing wire 1 and the driving board 7 are made flush with each other or set aside from each other; however, in the second embodiment, a wire driving member is driven.

Figure 11:
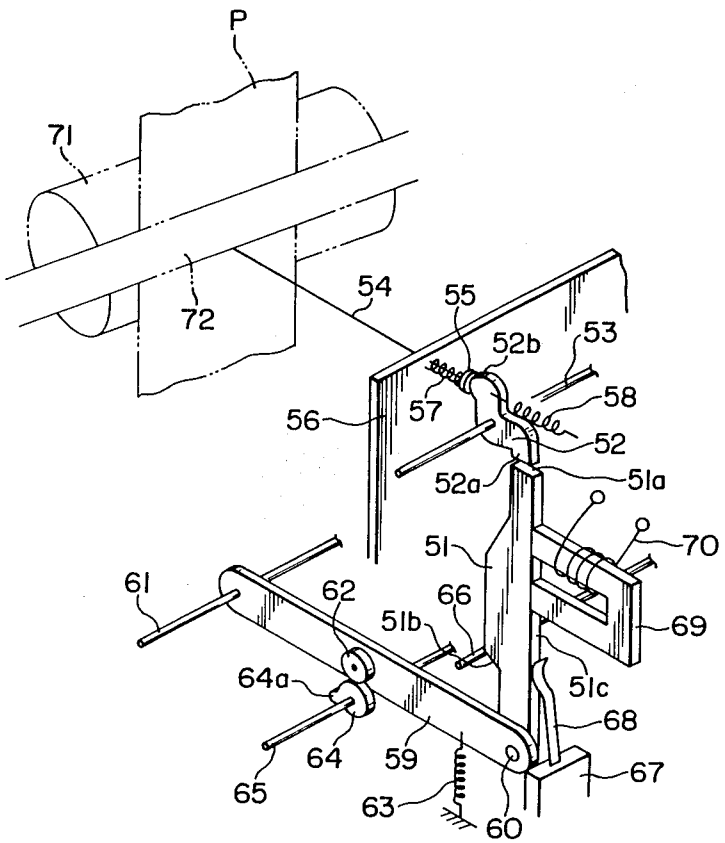
FIG. 11 is a perspective view of a printing wire driving device for wide dot printers which is a second embodiment of the present invention.

FIG. 11 is a perspective view of a printing wire driving device for wire dot printers which is the second embodiment of the present invention.

As shown in FIG. 11, a substantially L-shaped driving lever 52 is provided above one end portion of a wire driving member, namely, a driving bar 51. The driving lever 52 is rotatably mounted on a stationary shaft 53. One end portion of the driving lever 52 which confronts with one end portion 51*a* of the driving bar 51 is formed into a protruded striking part 52*a*. A printing wire 54 is arranged on the side of the other end portion of the driving lever 52 in such a manner that the printing wire is substantially perpendicular to the driving bar 51.

A bearer 55 is connected to the rear end of the printing wire 54, so that it is struck by the protruded part 52*b* of the other end portion of the driving lever 52.

The printing wire 54 is extended through a stationary plate 56. A first elastic member, namely, a returning spring 57 is provided between the stationary plate 56 and the bearer 55 in such a manner that the spring 57 is put on the printing wire 54. The spring 57 is used to return the printing wire 54 to the original position.

A returning spring 58 is connected to the other end portion of the driving lever 52 so as to urge the driving lever 52 in the direction opposite to the printing wire driving direction thereby to return the driving lever 52 which has been driven by the driving bar 51.

One end portion of a lever 59 is rotatably coupled through a shaft 60 to the other end portion of the driving bar 51. The other end portion of the lever 59 is rotatably mounted on a stationary supporting shaft 61. A cam roller 62 is rotatably mounted on the lever 59 substantially at the middle. A returning spring 63 is connected to the part of the lever 59 which is located between the roller 62 and the shaft 60 and near the latter 60, in order to return the driving bar 51 which has been driven.

A cam 64 is provided below the cam roller 62. The cam 64 is mounted on a driving shaft 65 and is driven by a motor (not shown). The cam roller 62 is kept in contact with the cam 64 by the elastic force of the returning spring 63 at all times. The cam 64 has a protruded part 64*a*. Therefore, as the cam 64 is rotated while being in contact with the cam roller 62, the lever 59 is swung about the stationary shaft 61 by the protruded part 64*a* of the cam 64, and accordingly the driving bar 51 is moved towards the driving lever 52.

The side surface of the driving bar 51 which is one the side of the lever 59 (or one the left-handed side in FIG. 11) is abutted against a stationary shaft 66 which is arranged perpendicular to the driving bar 51. The side surface of the driving bar 51 includes a tapered guide surface 51*b* which is inclined towards the other end of the driving bar 51. The other side surface 51*c* of the driving bar 51 which is opposite to the aforementioned side surface, or the right side surface in FIG. 11, is flat and abutted against one end of a second elastic member, namely, a leaf spring 68 the other end of which is fixedly secured to a stationary member 67. Therefore, the driving bar 51 is urged toward the stationary shaft 66 by the elastic force of the leaf spring 68. A substantially U-shaped control electromagnet 69 is abutted against the right side surface 51*c* substantially at the middle. The control electromagnet 69 is adapted to attract the driving bar 51 in response to a printing instruction.

The operation of the printing wire driving device thus constructed will be described with reference to FIGS. 12 through 14.

Figure 12:
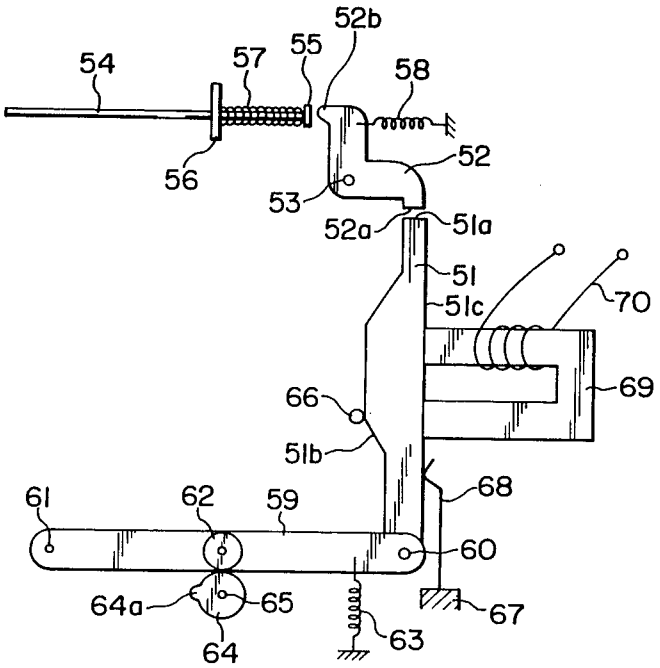
FIGS. 12, 13 and 14 are side views depicting the operation of the driving device shown in FIG. 11. More specifically.
Figure 13:
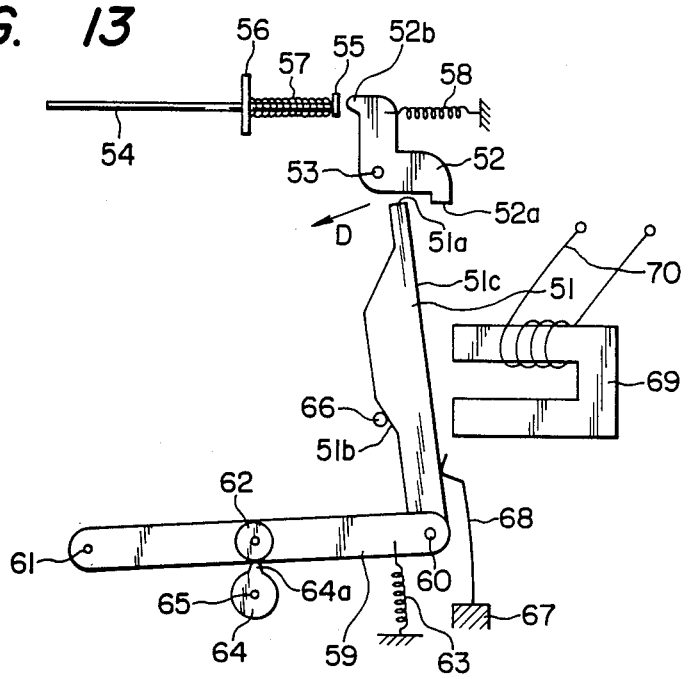

FIG. 12 shows the standby state of the driving device in which the lever 59 is not driven by the cam 64 yet. As the level 59 is swung upwardly by the protruded part 64*a* of the cam 64, the driving bar 51 is moved towards the driving lever 52. However, under the conditions that no printing instruction is issued and the driving bar 51 is not attracted by the control electromagnet 69, the driving bar 51 is driven as shown in FIG. 13. In this case, since the driving bar 51 is urged toward the stationary shaft 66 by the leaf spring 68, the driving bar 51 is guided along its tapered guide surface 51*b* while the latter 51*b* is being abutted against the stationary shaft 66. As a result, the driving bar 51 is moved in the direction of the arrow D in FIG. 13 so that the one end portion 51*a* of the driving bar 51 is moved away from the striking part 52*a* of the driving lever 52. Therefore, in this case, the printing wire 54 is not driven.

Figure 14:
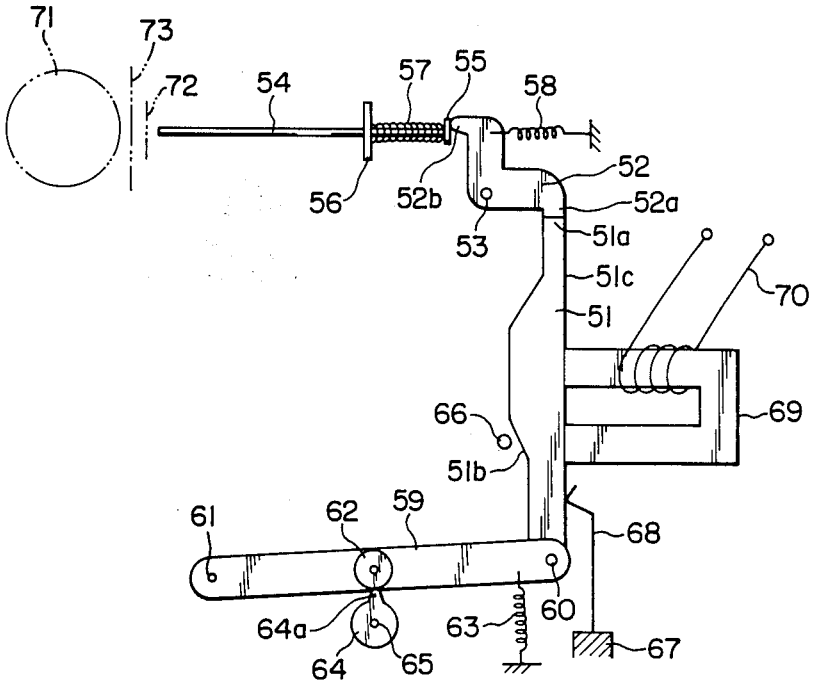

When the coil 70 of the control electromagnet 69 is energized according to the printing instruction, the electromagnet 69 attracts the driving bar 51 against the elastic force of the leaf spring 68 as shown in FIG. 14. Therefore, the driving bar 51 is slid towards the driving lever 52 with the right side surface 51*c* of the driving bar 51 attracted by the electromagnet 69, so that the one end portion 51*a* of the driving bar 51 hammers the striking part 52*a* of the driving lever 52. Simultaneously the protruded part 52*b* of the driving lever 52 strikes the bearer 55 of the printing wire 54, so that the character is printed on the printing sheet P arranged between the platen 71 and the printing ribbon 72.

Thereafter, the printing wire 54 is returned to be original position by the returning spring 57, while the driving lever 52 and the driving bar 51 are also returned to the original positions by the returning springs 58 and 63, respectively, as shown in FIG. 11. That is, the driving device is placed in the standby state again.

As was described above, in the printing wire driving device of FIG. 11, the control electromagnet 69 is abutted against the driving bar 51. Therefore, the control electromagnet can attract and hold the driving bar 51 immediately in response to the printing instruction, and accordingly the printing wire 54 can be driven with high accuracy.

The rotating cam 64 is utilized to drive the printing wire. That is, the printing wire is driven by a relatively large driving power. Therefore, a wire dot printer using the above-described driving device can perform an embossing type printing operation and a copying type printing operation. Accordingly, the printer can be employed as a check writer for instance, and desired characters or symbols, which are not limited to those of fixed types, can be emboss-printed in dot form.

In the above-described driving device, when the printing wire 54 is driven, the driving bar 51 is maintained held by the electromagnet 69. This printing control can be achieved by a small power which is merely against the elastic force of the leaf spring 68.

Accordingly, the printing control can be positively carried out, the power consumption for the control is small, and the electromagnet 69 may be of a small one. Furthermore, the driving device is simple in construction, which contributes to a reduction of the manufacturing cost of the wire dot printer.

In the above-described second embodiment, the electromagnet 69 is employed to control the wire driving member, i.e., the driving bar. Since the wire driving member can be controlled with relatively small power, similarly as in the first embodiment a transducer such as for instance a piezo-actuator can be employed in order to control the driving bar 51.

The printing wire driving device which is so modified as to employ the piezo-actuator will be described with reference to FIGS. 15 through 17.

Figure 15:
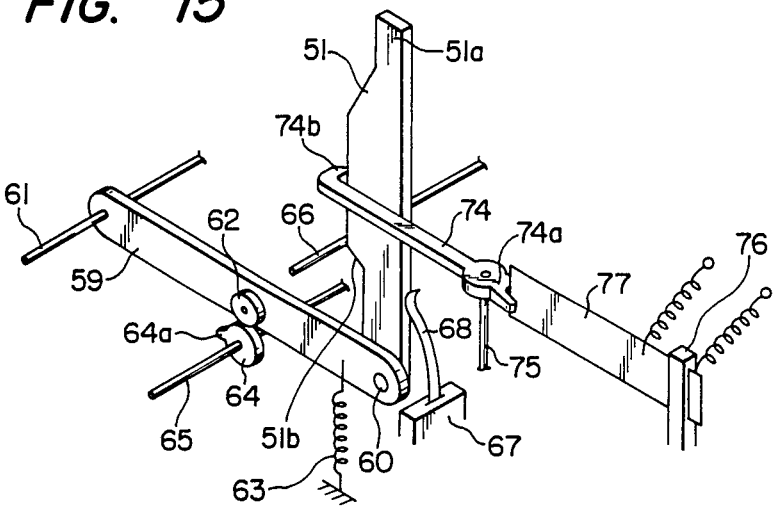
FIG. 15 is a perspective view of the driving device of FIG. 11 which is so modified that a piezoactutor is employed as its holding means.

As shown in FIG. 15, a hook lever 74 one end portion of which is bent like a book is arranged beside the driving bar 51 near the middle.

The base end portion of the hook lever 74 is rotatably mounted on a stationary shaft 75. A substantially V-shaped cut 74*a* is formed in the base end portion. The V-shaped cut 74*a* is engaged with one end of the piezo-actuator 74 the other end of which is fixedly secured to a stationary member 76.

Figure 16:
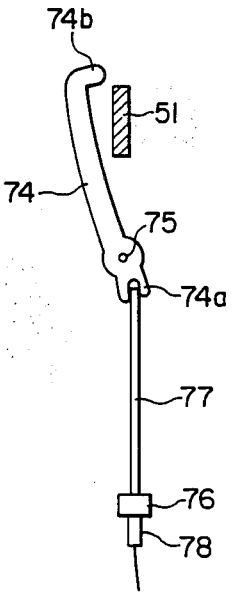
FIGS. 16 and 17 are plan views depicting the operation of the piezo-actuator in the driving device of FIG. 15.

When no printing instruction is issued and the piezo-actuator 77 is not energized, the end portion of the hook lever 74, namely, a hook 74*b* is set apart from the driving bar 51 as shown in FIG. 16. In this case, even if the driving bar 51 is driven by the cam 64, the driving bar 51, being energized by the leaf spring 68, is guided along the tapered guide surface 51*b*. Therefore, the driving bar 51 is driven in such a manner that the one end portion 51*a* of the driving bar 51 is moved away from the driving lever 52. Accordingly, in this case, the printing wire 54 is not driven.

Figure 17:
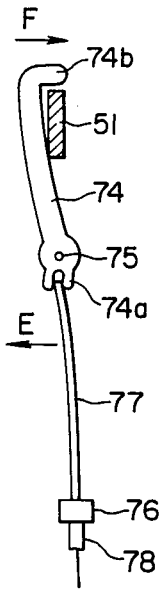

When the piezo-actuator 77 is energized in response to the printing instruction, the other end portion of the actuator 77 is moved in the direction of the arrow E in FIG. 17. As the other end portion of the actuator 77 is engaged with the cut 74*a* of the hook lever 74, the hook 74*b* is swung about the stationary shaft 75 in the direction of the arrow F, thus engaging with the driving bar 51. Under this condition, the driving bar 51 is driven. Therefore, the driven bar 51 is slid while being held by the hook lever 74. As a result, similarly as in the above-described case, the driving lever 52 strikes the printing wire 54, so that the character is printed.

In the second embodiment described above, the driving lever 52 which is swingably supported is coupled to the other end of the driving bar 51; however, the driving device may be so modified that the other end the driving bar 51 is pushed by the cam 64.

Furthermore, the driving device may be so modified that the driving lever 52 is eliminated, and instead the one end 51*a* of the driving bar 51 directly strikes the bearer 55 of the printing wire 54. In this case, the bearer 55 serves as the striking part also for the one end of the driving bar.

As is apparent from the above description, in the printing wire driving device of the present invention, the holding means, namely, the control electromagnet or the piezo-actuator is arranged in such a manner that it abuts against the wire holding member or the wire driving member. Therefore, in response to the printing instruction, the electromagnet can attract and hold the wire holding member or the wire driving member with no time lag. Accordingly, the printing wire can be positively driven with high accuracy. Furthermore, the control can be achieved with the small power which is merely against the elastic force of the leaf spring. Therefore, the printing control can be positively performed, the power consumption required for the control is small, and the control electromagnet may be small one. In addition, the driving device of the present invention is simple in construction, which contributes to reduction of the manufacturing cost of the wire dot printer.

I claim:

1. A printing wire driving device in a wire dot printer for printing on a surface, comprising:

a printing wire, one end of which is adapted to be operatively engaged and hammered for printing;

a wire driving means for operatively engaging and hammering the one end of said printing wire;

an eccentric cam for driving said wire driving means from an original position spaced from said surface toward operative engagement with the printing wire;

a first elastic member for returning said printing wire to an original position after said wire has been hammered by said wire driving means;

a printing wire support member for slidably supporting said printing wire;

a second elastic member for urging said printing wire support member so as to urge at least one of said wire driving means and said printing wire into a displaced orientation when said wire driving means is driven in a direction for hammering said printing wire so that said one end of said printing wire and said wire driving means cannot be operatively engaged;

guide means operatively coupled to said wire driving means for aligning said wire driving means and said one end of said printing wire against the force of said second elastic member in synchrony with an operation of said wire driving means by supporting said printing wire support member when said wire driving means is returned to the original position thereof;

maintaining means for maintaining a position of said printing wire support member so as to operatively maintain said wire driving means and said one end of said printing wire in operative alignment with each other, against the force of said second elastic member, in response to a printing command; and whereby, the portion of said printing wire supported by said printing wire support member is moved toward the maintaining position provided by said maintaining means due to the action of said guide means when said wire driving means is returned to the original position thereof and power is supplied to said maintaining means according to the printing command.

2. A printing wire driving device as claimed in claim 1, wherein said first elastic member is a spring.

3. A printing wire driving device as claimed in claim 1, wherein said maintaining means is operatively coupled to said holding member in opposition to the force of said second elastic member in response to a printing command.

4. A printing wire driving device as claimed in claim 3, wherein said maintaining means comprises an electromagnetic element, said holding member including an upperwardly extending portion which is held in engagement with said electromagnetic element when said electromagnetic element is energized.

5. A printing wire driving device as claimed in claim 3, wherein said maintaining means comprises a hook lever element coupled to a piezo-actuator element, said holding member including an upperwardly extending portion which is held in engagement with said hook lever element when said piezo-actuator element is energized.

6. A printing wire driving device as claimed in claim 1, wherein said guide means slidably engages said wire driving means and said second elastic member urges said wire driving means against said guide means.

7. A printing wire driving device as claimed in claim 6, wherein said maintaining means is operatively coupled to said wire driving means in opposition to the force of said second elastic member in response to a printing command.

8. A printing wire driving device as claimed in claim 7, wherein said maintaining means comprises an electromagnetic element, said wire support member being held in abutting engagement with said electromagnetic element when said electromagnetic element is energized.

9. A printing wire driving device as claimed in claim 7, wherein said maintaining means is a hook lever element coupled to a piezo-actuator element, said wire support member being held in engagement with said hook lever element when said piezo-actuator element is energized.

10. A printing wire driving device in a wire dot printer for printing on a surface, comprising:

a printing wire, one end of which is adapted to be operatively engaged and hammered for printing;

a wire driving means for operatively engaging and hammering the one end of said printing wire, said wire driving means including a wire driving element and a wire driving lever, said wire driving element being aligned with and adapted to displace said wire driving lever so that said wire driving lever operatively engages and hammers said printing wire;

an eccentric cam for driving said wire driving means from an original position spaced from said surface toward operative engagement with the printing wire;

a first elastic member for returning said printing wire to an original position after said wire has been hammered by said wire driving means;

a second elastic member for urging said wire driving means into a displaced orientation so that said one end of said printing wire and said wire driving means cannot be operatively engaged;

guide means for aligning said wire driving means and said one end of said printing wire against the force of said second elastic member by slidably engaging said wire driving means when said wire driving means is returned to the original position thereof, said second elastic member urging said wire driving means against said guide means; and maintaining means for maintaining a position of said wire driving means so as to operatively maintain said wire driving means and said one end of said printing wire in operative alignment with each other, against the force of said second elastic member, in response to a printing command whereby, the portion of said wire driving means held by said guide means is moved toward the maintaining position provided by said maintaining means due to the action of said guide means when said wire driving means is returned to the original position thereof and power is supplied to said maintaining means according to the printing command.

11. A printing wire driving device as claimed in claim 10, wherein said second elastic member is adapted to displace said wire driving element from alignment with said wire driving lever.

12. A printing wire driving device as claimed in claim 11, wherein said wire driving lever is rotatably mounted.

13. A printing wire driving device as claimed in claim 12, wherein said maintaining means is operatively coupled to said wire driving element in opposition to the force of said second elastic member in response to said printing command.

14. A printing wire driving device as claimed in claim 13, wherein said maintaining means is an electromagnetic element, said wire driving element being held in engagement with said electromagnetic element when said electromagnetic element is energized.

15. A printing wire driving device as claimed in claim 13, wherein said maintaining means is a hook lever element coupled to a piezo-actuator element, said wire driving element being held in engagement with said hook lever element when said piezo-actuator element is energized.

16. A printing wire driving device as claimed in claim 12, further comprising a third elastic member for returning said wire driving lever to its original position after hammering said printing wire.

17. A printing wire driving device as claimed in claim 16, further comprising a fourth elastic member for returning said wire driving element to its original position after engaging said wire driving lever.

* * * * *